US005567898A

United States Patent [19]

Shalev

[11] Patent Number: 5,567,898

[45] Date of Patent: Oct. 22, 1996

[54] WHISTLE AND TAMBOURINE COMBINATION

[76] Inventor: Efraim Shalev, Laurel Canyon Annex, North Hollywood, Calif. 91605

[21] Appl. No.: 380,395

[22] Filed: Jan. 30, 1995

[51] Int. Cl.[6] ..... G10D 13/02

[52] U.S. Cl. ..... 84/418; 84/DIG. 12

[58] Field of Search ..... 84/418, DIG. 12, 84/170

[56] References Cited

U.S. PATENT DOCUMENTS 3,704,340 11/1972 Hall ..... 84/170

4,974,484 12/1990 King ..... 84/418

*Primary Examiner*—Patrick J. Stanzione

[57] ABSTRACT

An improved musical instrument having an improved tambourine and a built-in whistle, integrated into one musical instrument. The improved musical instrument includes an additional outside frame to cover and protect the jingles for safety.

1 Claim, 1 Drawing Sheet

FIG. 3
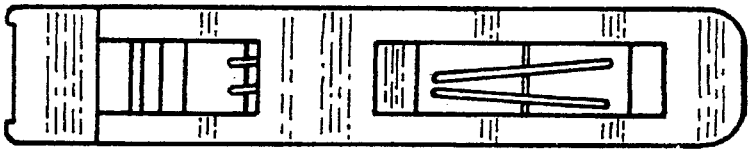
FIG. 2
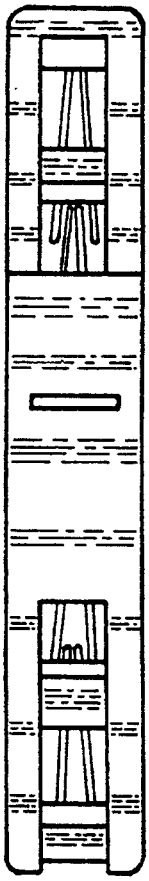
FIG. 4
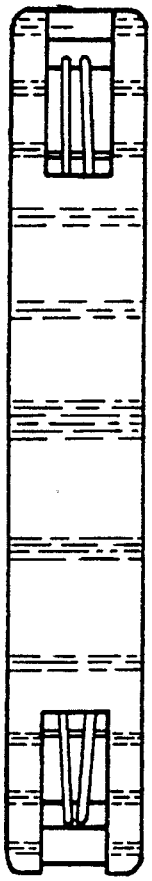
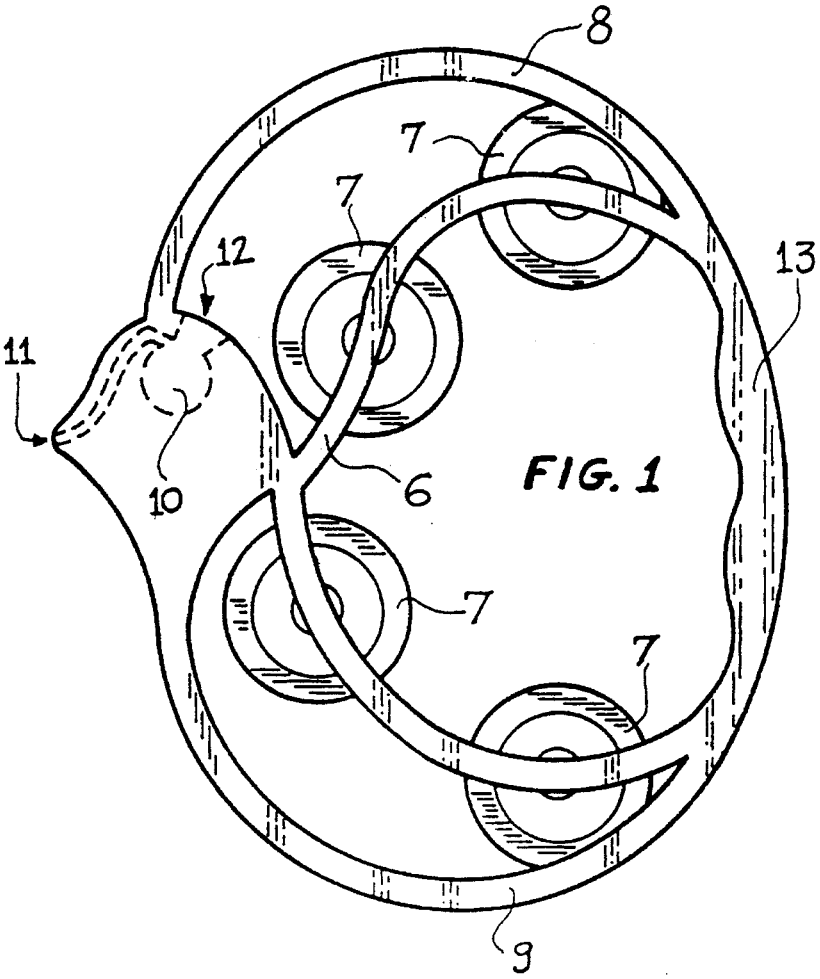
FIG. 1
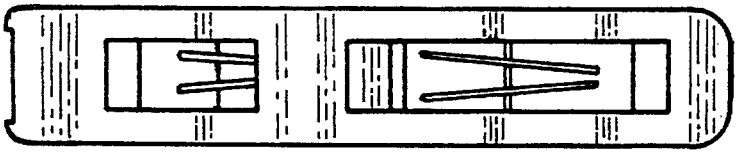
FIG. 5

WHISTLE AND TAMBOURINE COMBINATION

BACKGROUND OF THE INVENTION

The present invention relates to tambourines which are, in general, musical instruments or perccussion.

Tambourines generate sounds by shaking pairs of jingles (discs of metal) against each other.

The jingles are mounted on a frame or shell and free to move in their slots when the tambourine is shaken.

SUMMARY OF THE INVENTION

The conventional tambourines are made of all kinds of frames or shells, in different shapes and sizes, but all of them contain slots with jingles for the only purpose of shaking jingles against each other in order to produce sounds, generated by the metal of the jingles.

The conventional tambourine consists pairs of jingles, mounted on a frame or shell by pins which go through each jingle at its center. This leaves a half of each jingle exposed outside the shell, uncovered and unprotected.

When tambourines are played among groups, especially among children, the sharp edges of the jingles may cause harmful injury.

My invention includes two improvments to the conventional tambourine.

The first improvment is by building a whistle inside the frame or shell of the tambourine and creating a new musical instrument.

The Whistletambourine can be played as a conventional tambourine, as a whistle or together at the same time.

The second improvement is regarding the safety and protection from injury, when playing the tambourine.

By adding an additional frame which covers and protects the sharp edges of the jingles from being exsposed outside of the basic frame or body of the tambourine.

BRIEF DESCRIPTION OF THE DRAWING

FIG. 1 is a front elevational view of the invention,

FIG. 2 is a side elevational view,

FIG. 3 is a top elevational view,

FIG. 4 is a side elevational view, opposite to FIG. 2, and

FIG. 5 is a bottom plan view.

DESCRIPTION OF THE INVENTION AND DRAWINGS

Reffering to the drawings in sheet # 1, and especially to FIG. 1 shown is the new musical instrument which contains the basic frame (6) of a tambourine, jingles (7) in their slots in the basic frame (6), the additional added outside protective frame marked (8) and (9), which is added to protect and cover the sharp edges of the jingles (7).

A built-in whistle (10) can be played by blowing air into hole (11).

The air exits the whistle from hole (12).

In general, the player will hold the Whistletambourine by the handle (13).

What I claim is:

1. A musical instrument comprising:

a tambourine body supporting a plurality of jingle members inside of a protective frame member such that the edges of said jingles are not exposed outside of said frame member, said frame member having a built-in whistle including an entrance hole and an exit hole such that when air is blown into said whistle member a whistling sound is produced.

* * * * *